US010758450B2

(12) United States Patent
Sedic

(10) Patent No.: US 10,758,450 B2
(45) **Date of Patent: *Sep. 1, 2020**

(54) MOTION-BASED CONTROL FOR A PERSONAL MASSAGER

(71) Applicant: LELO Inc., San Jose, CA (US)

(72) Inventor: Filip Sedic, Stockholm (SE)

(73) Assignee: LELO Inc., San Jose, CA (US)

( * ) Notice: Subject to any disclaimer, the term of this patent is extended or adjusted under 35 U.S.C. 154(b) by 863 days.

This patent is subject to a terminal disclaimer.

(21) Appl. No.: 15/440,369

(22) Filed: Feb. 23, 2017

(65) Prior Publication Data

US 2017/0156972 A1 Jun. 8, 2017

Related U.S. Application Data

(63) Continuation of application No. 13/492,909, filed on Jun. 10, 2012, now Pat. No. 9,615,994.

(Continued)

(51) Int. Cl.

| | |
|---|---|
| ***A61H 23/00*** | (2006.01) |
| ***A61H 19/00*** | (2006.01) |
| *A61H 23/02* | (2006.01) |

(52) U.S. Cl.

CPC ..... *A61H 19/44* (2013.01); *A61H 19/34* (2013.01); *A61H 23/00* (2013.01); *A61H 23/02* (2013.01);

(Continued)

(58) Field of Classification Search

CPC ..... A61H 19/00; A61H 19/30; A61H 19/32; A61H 19/34; A61H 19/40; A61H 19/44; A61H 19/50; A61H 21/00

See application file for complete search history.

(56) References Cited

U.S. PATENT DOCUMENTS

| | | | |
|---|---|---|---|
| 1,636,159 | A | 7/1927 | Unne |
| 3,504,665 | A | 4/1970 | Bakunin et al. |

(Continued)

FOREIGN PATENT DOCUMENTS

| | | | |
|---|---|---|---|
| CA | 2 491 249 | A1 | 6/2006 |
| CN | 2226936 | Y | 5/1996 |

(Continued)

OTHER PUBLICATIONS

First Office Action for Chinese Patent Application No. CN 201610523296.4, dated Aug. 22, 2017, 8 Pages.

(Continued)

*Primary Examiner* — Michael J Tsai

(74) *Attorney, Agent, or Firm* — Fenwick & West LLP

(57) ABSTRACT

A personal massage apparatus includes a personal massager and can also include a controller for controlling the operation of the massager. The massager includes a motor or other motion-causing device and can also include an interface (e.g., a wireless interface) to the controller (where such a controller is included). The controller is a remote control that can include a motion sensor (e.g., an accelerometer) for detecting motion of the controller (e.g., changes in orientation). The massager can also have a motion sensor for detecting motion of the massager. Circuitry in the controller and/or massager converts the detected motion of the controller or massager into control signals for the controller or massager. The operation of the controller or massager (e.g., the output motor power, a vibration pattern, or another massage setting) is adjusted based on the detected motion of the controller or massager.

22 Claims, 9 Drawing Sheets

Related U.S. Application Data

(60) Provisional application No. 61/504,943, filed on Jul. 6, 2011.

(52) U.S. Cl.
CPC ..... *A61H 2201/1207* (2013.01); *A61H 2201/165* (2013.01); *A61H 2201/501* (2013.01); *A61H 2201/5064* (2013.01); *A61H 2201/5069* (2013.01); *A61H 2201/5071* (2013.01); *A61H 2201/5084* (2013.01); *A61H 2201/5097* (2013.01); *A61H 2230/065* (2013.01); *A61H 2230/505* (2013.01)

(56) References Cited

U.S. PATENT DOCUMENTS 3,554,184 A 1/1971 Habib
3,626,931 A 12/1971 Bysakh
3,938,018 A 2/1976 Dahl
3,978,851 A 9/1976 Sobel
3,996,930 A 12/1976 Sekulich
4,066,075 A 1/1978 Hughes
4,156,620 A 5/1979 Clemens
D273,132 S 3/1984 Moloff
4,488,541 A 12/1984 Garcia
4,574,791 A 3/1986 Mitchener
4,800,328 A 1/1989 Bolger et al.
4,827,551 A 5/1989 Maser et al.
4,845,795 A 7/1989 Crawford et al.
4,920,986 A 5/1990 Biswas
5,460,597 A 10/1995 Hopper
D376,650 S 12/1996 Kain
5,680,028 A 10/1997 McEachern
5,690,603 A 11/1997 Kain
5,693,002 A 12/1997 Tucker et al.
5,713,833 A 2/1998 Milligan
5,797,950 A 8/1998 Takashima
5,853,362 A 12/1998 Jacobs
5,871,533 A 2/1999 Boutos
5,929,598 A 7/1999 Nakama et al.
5,959,433 A 9/1999 Rohde
6,053,881 A 4/2000 Boodramsingh et al.
6,132,366 A 10/2000 Ritchie et al.
6,179,775 B1 1/2001 Thompson
6,183,426 B1 2/2001 Akisada et al.
6,190,307 B1 2/2001 Tsai
6,217,533 B1 4/2001 McCambridge
6,275,681 B1 8/2001 Vega et al.
6,350,230 B1 2/2002 Kontos
6,368,268 B1 * 4/2002 Sandvick ..... A61H 19/44 600/38
6,572,569 B2 6/2003 Klein
6,592,516 B2 7/2003 Lee
6,685,660 B1 2/2004 Taverna et al.
6,741,895 B1 5/2004 Gafni et al.
6,790,189 B2 9/2004 Kobayashi et al.
D515,704 S 2/2006 Nan
7,001,317 B2 2/2006 Marcotte
7,081,087 B2 7/2006 Jannuzzi
7,104,950 B2 * 9/2006 Levy ..... A61H 19/44 600/38
7,166,072 B2 1/2007 Smith
7,347,815 B2 * 3/2008 Serbanescu ..... A61H 19/34 600/38
7,383,728 B2 6/2008 Noble et al.
7,438,681 B2 * 10/2008 Kobashikawa ..... A61H 19/34 600/38
7,530,944 B1 5/2009 Kain
7,577,476 B2 * 8/2009 Hochman ..... A61B 5/0002 600/29
D604,425 S 11/2009 Stewart
D605,779 S 12/2009 Murison
7,658,676 B2 * 2/2010 Ohta ..... A63F 13/428 463/37
7,749,178 B2 7/2010 Imboden et al.
7,762,945 B2 * 7/2010 Blumenthal ..... A61H 19/00 600/38
7,815,582 B2 10/2010 Imboden et al.
D630,762 S 1/2011 Elliott
7,931,605 B2 * 4/2011 Murison ..... A61H 19/50 601/70
7,938,789 B2 5/2011 Imboden et al.
8,012,082 B1 * 9/2011 Lefew ..... A61H 19/00 600/38
D665,094 S 8/2012 Sedic
8,371,999 B2 2/2013 DeAlva
D681,221 S 4/2013 Chen
D681,224 S 4/2013 Chen
D685,492 S 7/2013 Chen
D688,381 S 8/2013 Marshall
D688,383 S 8/2013 Manabe
8,512,226 B2 8/2013 Mark
8,622,890 B1 1/2014 Caggiano et al.
D700,347 S 2/2014 Sedic
D712,059 S 8/2014 Sedic
D714,953 S 10/2014 Marshall
D723,179 S 2/2015 Elliott
2002/0065477 A1 5/2002 Boyd et al.
2002/0103415 A1 * 8/2002 Manska ..... A61H 19/44 600/38
2002/0188233 A1 12/2002 Denyes
2003/0023139 A1 1/2003 Hartz
2003/0073881 A1 4/2003 Levy
2003/0097041 A1 5/2003 Ritchie et al.
2003/0195441 A1 10/2003 Firouzgar
2004/0186344 A1 9/2004 Jannuzzi
2004/0230093 A1 11/2004 Marshall
2005/0075072 A1 4/2005 Apitzsch
2005/0155609 A1 7/2005 Lin
2005/0203335 A1 9/2005 Stachon
2005/0273024 A1 12/2005 Nan
2006/0030749 A1 2/2006 Hung et al.
2006/0106327 A1 5/2006 Thielen et al.
2006/0278514 A1 12/2006 Roussin Bouchard
2007/0038019 A1 2/2007 Weng
2007/0126593 A1 * 6/2007 Nan ..... A61H 19/44 340/12.22
2007/0179412 A1 * 8/2007 Imboden ..... A61H 19/00 601/72
2007/0179413 A1 8/2007 Imboden et al.
2008/0009775 A1 1/2008 Murison
2010/0174137 A1 7/2010 Shim
2011/0071445 A1 3/2011 Imboden et al.
2012/0215141 A1 * 8/2012 Peddicord ..... A61N 1/0524 601/46

FOREIGN PATENT DOCUMENTS

CN 2256733 Y 6/1997
CN 2256734 Y 6/1997
CN 2430153 Y 5/2001
CN 1368039 A 9/2002
CN 2699871 Y 5/2005
CN 2759457 Y 2/2006
CN 2817822 Y 9/2006
EP 1 477 149 A1 11/2004
GB 2 376 890 A 12/2002
GB 2 375 714 B 12/2004
JP 2002-028210 A 1/2002
JP 2004-313690 A 11/2004
JP 2005-288079 A 10/2005
WO WO 99/37267 A1 7/1999
WO WO 02/38100 A2 5/2002
WO WO 03/068130 A1 8/2003
WO WO 03/089071 A2 10/2003
WO WO 2006/063461 A1 6/2006
WO WO 2008/077144 A1 6/2008

(56) References Cited

FOREIGN PATENT DOCUMENTS

WO WO 2014/008606 A1 1/2014
WO WO 2015/054436 A1 4/2015

OTHER PUBLICATIONS

Acrylic Xtc Pleasure Curve, Swedish Erotica, Discreet-Romance.com, 2 pages, [online] [retrieved Dec. 26, 2012], Retrieved from the internet <http://www.discreet-romance.com/acrylic-pleasure-curve-clear-adult-se-x-toys-21708.html>.
Berman Center Adonis GSpot/Clitoral Stimulator, Berman Center, Amazon.com, 2 pages, [online] [retrieved Dec. 26, 2012], Retrieved from the internet <http://www.amazon.com/Berman-Center-Adonis-Clitoral-Stimulator/dp/B00- 0C90AY6>.
Chead118, The Bumble Bee, four pages, [online][retrieved from the internet Jun. 23, 2015], Retrieved from the internet <http://dodsonandross.com/node/1655>.
Doc Johnson Vivid G-Spot Tickler—Savanna, DocJohnson.com, 1 page, [online] [retrieved Dec. 26, 2012], Retrieved from the internet <http://www.docjohnson.com/vivid-g-spot-tickler-purple.html>.
Double Ended Self-Pleasurizer, Too Timid, Atlantic Innovations, LLC, 4 pages, [online] [retrieved Dec. 27, 2012], Retrieved from the internet <http://www.tootimid.com/double-ended-self-pleasurizer.htmlf>.
Double Pleaser Jelly, Adam and Eve Toys, Newhaba.com, 2 pages, [online] [retrieved Jan. 11, 2013], Retrieved from the internet <http://www.newhaba.com/adamandevetoys/7525.htm>.
Dual Penetrator.TM. Vibrator, California Exotic Novelties, CalExotics.com, 2 pages, [online] [retrieved Dec. 26, 2012], Retrieved from the internet <http://www.calexotics.com/p-22479-dual-penetrator-vibrator.aspx>.
Dual Rocker, California Exotic Novelties, EdenFantasys.com, 2 pages, [online] [retrieved Dec. 26, 2012], Retrieved from the internet <http://www.edenfantasys.com/dual-rockedadult-toys-dvds-15152>.
Dual Vibrating Flexi-Dong.TM., California Exotic Novelties, CalExotics.com, 2 pages, [online] [retrieved Dec. 26, 2012], Retrieved from the internet <http://www.calexotics.com/p-22326-dual-vibrating-flexi-dong.aspx>.
Elite 7X 7 Function Massager With Silicone Sleeve, Swedish Erotica, Spicetoy.com, 3 pages, [online] [retrieved Dec. 26, 2012], Retrieved from the internet <http://www.spicetoy.com/elite-7x-7-function-massager-with-silicone-sl- eeve.html>.
Elite 7X 7 Function Sea Lion, Swedish Erotica, Ourtoys.com, 1 page, [online] [retrieved Dec. 26, 2012], Retrieved from the internet <http://ourtoys.com/0575-12-3.htm>.
"Evolved Novelties Bendable You Too, Purple, by Evolved Novelties" Amazon.com, Inc., 1996-2012, 4 pages, [Online] [Retrieved on Aug. 13, 2012], Retrieved from the Internet<URL:http://www.amazon.com/Evolved-Novelties-Bendable-You-Purp- le/dp/B004FV9WWC>.
Femme Fatale G-Spot Teaser Pleaser, Nasstoys of New York, Nasstoys.com, 2 pages, [online] [retrieved Dec. 26, 2012], Retrieved from the internet <http://www.nasstoys.com/products/details.cfm?ProductID=2020-1>.
Fujiko's Asian Odyssey with Dual Pronged Stimulator, California Exotic Novelties, VitaSprings.com, 2 pages, [online] [retrieved Jan. 11, 2013], Retrieved from the internet <http://www.vitasprings.com/fujiko-asian-odyssey-california-exotic-nov- elties.html>.
Gemini Probe, Nasstoys of New York, Nasstoys.com, 1 page, [online] [retrieved Dec. 26, 2012], Retrieved from the internet <http://www.nasstoys.com/products/details.cfm?ProductID=1764>.
Hitachi Magic Wand and Deluxe G Spot Attachment Combo, Hitachi, Amazon.com, 2 pages, [online] [retrieved Dec. 26, 2012], Retrieved from the internet <http://www.amazon.com/Hitachi-Magic-Deluxe-Attachment-Combo/dp/B000RY- 6SHS>.
LELOi AB, "A Virtual Tour of How LELO Began," copyright date listed 2003-2013, one page, SIC 1002.sub.—0002.
LELOi AB, "An Idea is Born," copyright date listed 2003-2013, one page, SIC 1002.sub.—0003.
LELOi AB, "Introducing Lily," copyright date listed 2005-2006, one page, SIC 1002.sub.—0001.
LELOi AB, "The New Benchmark," copyright date listed 2003-2013, one page, SIC 1002.sub.—0004.
MaritalAide.com—Female Toys, eighteen pages, [online] [retrieved from the internet Dec. 29, 2016], Retrieved from the internet <http://web.archive.org/web/20031203221218/http://www.maritalaide.com/-sextoys/femaletoys.html>.
"Natural Contours Ultime Vibrator, Periwinkle Blue, by Natural Contours" Amazon.com, Inc., 1996-2012, 5 pages, [Online] [Retrieved on Aug. 13, 2012], Retrieved from the Internet<URL:http://www.amazon.com/gp/product/B00005LBRK/182-1904675-0- 619406>.
Nine Parts Desire, Snuggle Puss Product Detail Page, Nine Parts Desire, 2006, 1 page, [Online] [Retrieved on Jan. 7, 2010] Retrieved from the Internet<URL:http://www.ninepartsdesire.com/index.php?main.sub.—page=—product.sub.—in-fo&products.sub.—id=306 (last visited Jan. 7, 2010).
Original Jack Rabbit Vibrator, TheRabbitVibrator.com, 3 pages, [online] [retrieved Dec. 26, 2012], Retrieved from the internet <http://www.therabbitvibrator.com/original-jack-rabbit-vibrator.aspx&g- t;.
Patent Cooperation Treaty, International Search Report and Written Opinion, International Patent Application No. PCT/US2012/043167, dated Oct. 5, 2012, 13 pages.
Purr, Snuggle Puss Product Detail Page, Purr Inc., 2007, 1 page, [Online], [Retrieved on Jan. 7, 2010] Retrieved from the Internet<URL:http://www.mypurr.com/servlet/the-157/vibrators,-women,-p- leasure,-vibrati-on,/Detail (last visited Jan. 7, 2010).
Reflective Gel Smooth Double Dong, California Exotic Novelties, AdultSensations.com, 2 pages, [online] [retrieved Dec. 26, 2012], Retrieved from the internet <http://www.adultsensations.com/california-exotic-reflective-smooth-do- uble-dong-p-80.html>.
Reflective Gel.TM.—Double Dong 18", California Exotic Novelties, CalExotics.com, 2 pages, [online] [retrieved Dec. 26, 2012], Retrieved from the internet <http://www.calexotics.com/p-22143-reflective-gel-acdc-double-dong-18.- aspx>.
Rhodes, Philip, Sex Aids, The British Medical Journal, vol. 3, No. 5975, Jul. 12, 1975, pp. 93-95.
Rock-Chick G-Spot Vibrator, Rocks-Chick.com, 1 page, [online] [retrieved Dec. 26, 2012], Retrieved from the internet <http://www.rock-chick.com/productlist.php?product=RCPKV>.
Silicone Ultra.TM. Lighted Dolphin.TM. , California Exotic Novelties, www.SensualAdviser.com, 1 page, [online] [retrieved Dec. 26, 2012], Retrieved from the internet <http://www.sensualadviser.com/-/info.sub.—sex.sub.—toy/noveltyid=CE—0570-14.html>.
"Snuggle Puss," Purr Inc., 2007, 1 page, [Online] [Retrieved on Jun. 11, 2009] Retrieved from the Internet<URL:http://www.mypurr.com/servlet/the-157/vibrators,-women,-p- leasure,-vibration,/Detail>.
"Snugglepuss" product photo, Vibratex, 1 page, undated.
"Snugglepuss—G-spot Vibrator," Web Merchants, Inc., Last Updated Jan. 20, 2012, 3 pages, [Online] [Retrieved on Jan. 30, 2012] Retrieved from the Internet<URL:http://www.edenfantasys.com/vibrators/g-spot-vibrators/sn- ugglepuss>.
State Intellectual Property Office of the People's Republic of China, First Office Action, Chinese Patent Application No. 201280043116.2, dated Jan. 23, 2015, eighteen pages.
State Intellectual Property Office of the People's Republic of China, Second Office Action, Chinese Patent Application No. 201280043116.2, dated Aug. 14, 2015, seven pages.
Tantus Feeldoe Slim Vibrator, Tantusinc.com, 1 page, [online] [retrieved Dec. 26, 2012], Retrieved from the internet <http://tantusinc.com/catalog/Specialty-Items/Feeldoe-Slim>.
The LILY Exhibit 1002 to IPR of U.S. Pat. No. 7,749,178, 4 pages, [online], [Retrieval date unknown], copyright date p. 1 listed 2005-2006, copyright date pp. 2-4 listed 2003-2013, Retrieved from the internet<http://www.lelo.com/staticPage.php?page=10years>.
The Pincher Ribbed G-spot Dildo, Trinity Vibes, Amazon.com, 3 pages, [online] [retrieved Dec. 26, 2012], Retrieved from the internet <http://www.amazon.com/The-Pincher-Ribbed-G-spot-Dildo/dp/B0071B1PJ6&g-t;.

(56) References Cited

OTHER PUBLICATIONS

The Velvet Kiss Collection Little Dragon, Nasswalk of New York, Amazon.com, 3 pages, [online] [retrieved Dec. 26, 2012], Retrieved from the internet <http://www.amazon.com/Velvet-Collection-Little-Dragon-Lavender/dp/B00- 4KI70I8>.
U Send Me, Golden Triangle, FindAVibe.com, 2 pages, [online] [retrieved Dec. 26, 2012], Retrieved from the internet <http://www.findavibe.com/Anal-Sex-Toys/Anal-Vibrators/U-send-me.aspx&- gt;.
Ultime.TM., Natural Contours.RTM., 2 pages, [online] [retrieved Dec. 21, 2012], Retrieved from the internet <http://www.natural-countours.com/IBS/SimpleCat/Product/asp/product-id- /36716941.html>.
Water Missile Tear Drop Probe, California Exotic Novelties, QueensofPassion.com, 2 pages, [online] [retrieved Dec. 26, 2012], Retrieved from the internet <http://www.queens-of-passion.com/product/Watersub.—Missile.sub.—Te- ar.sub.—Drop.sub.—Probe.sub.—.sub.—Blue/0/SE0019122>.
www.Wayback.archive Nawtythings.com > Vibrating Cock Rings and Stimulators, three pages, [online] [retrieved from the internet Jun. 22, 2015], Retrieved from the internet <http://web.archive.org/web/20031217182606/http://nawtythings.com/cock- rings4.html>.
www.Wayback.archive Sex Toys 411 >>> Vibrators >> Shopping Tips > The Diving Dolphin, three pages, [online] [retrieved from the internet Jun. 23, 2015], Retrieved from the internet<http://web.archive.org/web/20031206182446/http://www.sextoys411.com/v-ibratorsub.—shopping.htm>.
www.Wayback.archive Vibrators.com > > Clitoral > The Virtual Bunny, one page, [online] [retrieved from the internet Jun. 22, 2015], Retrieved from the internet <http://web.archive.org/web/20030410205551/http://vibrators.com/v16351- .html>.
United States Advisory Action, U.S. Appl. No. 13/492,909, dated Mar. 10, 2014, three pages.
United States Office Action, U.S. Appl. No. 13/492,909, dated Mar. 6, 2013, 28 pages.
United States Office Action, U.S. Appl. No. 13/492,909, dated Oct. 10, 2012, 20 pages.
2nd Office Action for Chinese Patent Application No. CN 201610523296.4, dated Feb. 23, 2018, 6 Pages.

* cited by examiner

MOTION-BASED CONTROL FOR A PERSONAL MASSAGER

CROSS-REFERENCE To RELATED APPLICATIONS

This application claims the benefit of U.S. patent application Ser. No. 13/492,909, filed Jun. 10, 2012, which claims the benefit of Provisional patent application Ser. No. 61/504,943, filed Jul. 6, 2011. The content of these applications is hereby incorporated by reference in its entirety for all purposes.

BACKGROUND

The present invention relates generally to personal massagers, and more particularly to motion-based control for a personal massage apparatus.

Personal massagers can be operated in a number of manners. Some personal massagers include a user interface on the surface or handle of the massager itself. Others include an interface separate from the massager that allows the user to control the massager. The user can interact with whatever interface is included with the personal massager to turn the massager on or off, adjust the speed or vibration of the massager, or otherwise change settings of the massager during use. Having a convenient mechanism for controlling the personal massager makes it more likely that the user will enjoy the massager and be able to easily operate it.

Massagers having multiple buttons with which to interact, however, can be inconvenient and difficult for the user to manipulate while using the massager. A user distracted during use of the massager can accidentally select the wrong button and inadvertently turn the device on or off, or change a setting the user did not intend to change. For personal massagers that include a user interface on the surface or handle of the massager itself, if the interface of the massager is leaned against or otherwise under pressure, the settings on the massager can be changed without the user even intending to change them. In addition, it can be difficult to manipulate the handle of the massager while also selecting different user controls sitting on that same handle. For personal massagers that include a user interface separate from the massager, it can still be a challenge to select the correct buttons and modify the settings as desired while the massager is in use. The user still has to direct a substantial amount of focus to selecting the right button to adjust the right setting, drawing the user's attention away from simply enjoying the massager. Furthermore, the separate interface may be connected to the massager via wires that are inconvenient during usage of the massager. Thus, while designers of personal massagers have come up with a number of different types of interfaces for their massagers, these designs have certain drawbacks.

SUMMARY

Embodiments include an apparatus and method for motion-based control of a personal massager. In one embodiment, a motion-based personal massage apparatus includes a personal massager and a controller having an interface to the massager. The massager has a motor and at least one surface for interacting with a body. The controller has a motion sensor for detecting motion of the controller. Circuitry in the controller or the massager converts the detected motion of the controller into a control signal for the motor in the massager to adjust operation of the massager based on the detected motion of the controller. As one example, the user can hold the controller and move it around or change the orientation of the controller, and these movements are sensed by the sensor. Different movements or orientations of the controller can be associated with different settings for the massager. Thus, the user can move the controller in a particular manner or change to a particular orientation, and this motion will result in changing the setting of the massager. Rather than manipulating buttons on an interface associated with the massager, the user can choose to ignore any such buttons or other controls and instead move the remote controller to control the operation of the massager.

Another embodiment is a motion-based controller for a personal massager. The motion-based controller includes a control module for controlling the controller and includes a motion sensor in communication with the control module for detecting motion of the controller. The controller also includes an interface to the massager for sending signals to the massager regarding motion of the controller detected by a motion sensor, wherein adjustments are made in operation of the massager based on the detected motion of the controller.

A further embodiment is a motion-controlled personal massager. The massager includes a motor for moving the massager to interact with a body and includes a control module in communication with the motor for controlling operation of the massager. The massager may also include an interface to a controller for receiving signals from the controller regarding motion of the controller detected by a motion sensor. The control module of the massager may be configured to implement adjustments in the operation of the massager based on the detected motion.

Another embodiment is a motion-controlled personal massager that can be operated without a remote controller. The massager includes a motor for moving the massager to interact with a body and includes a control module in communication with the motor for controlling operation of the massager. The massager further includes a motion sensor for detecting motion of the massager. Circuitry in the massager converts the detected motion into a control signal for the motor in the massager to adjust operation of the massager based on the detected motion of the massager. Thus, in this embodiment, the apparatus does not have to include a remote controller (or such a controller can be included but used only when the user so desires). Instead, the user can control the operation of the massager by moving of the massager itself, and this motion is sensed by the motion sensor of the massager and translated to different operation settings of the massager.

An additional embodiment is a method for motion-based control of a personal massager. The method includes steps of detecting motion of a motion sensor in the massager or in a controller that is in communication with the massager and determining an adjustment to be made to operation of the massager or the controller based on the motion of the massager or the controller that was detected. The method further includes a step of converting the detected motion of the massager or the controller into a control signal for the massager or controller that adjusts the operation of the massager or controller in response to the detected motion of the massager or the controller. For example, the motion can be detected by a motion sensor in the controller, which determines the adjustment to the operation of the massager and which is converted into a control signal for the massager to adjust the massager operation. As another example, the motion can be detected by a motion sensor in the massager, which determines the adjustment to the operation of the massager and which is converted into a control signal for the massager to adjust the massager operation. As a further example, the motion can be detected by a motion sensor in the controller, which determines the adjustment to the operation of the controller and which is converted into a control signal for the controller to adjust the controller operation.

The features and advantages described in this summary and the following detailed description are not all-inclusive. Many additional features and advantages will be apparent to one of ordinary skill in the art in view of the drawings, specification, and claims hereof.

The figures depict various embodiments of the present invention for purposes of illustration only. One skilled in the art will readily recognize from the following discussion that alternative embodiments of the structures and methods illustrated herein may be employed without departing from the principles of the invention described herein.

DETAILED DESCRIPTION

Massage Apparatus

Figure 1A:
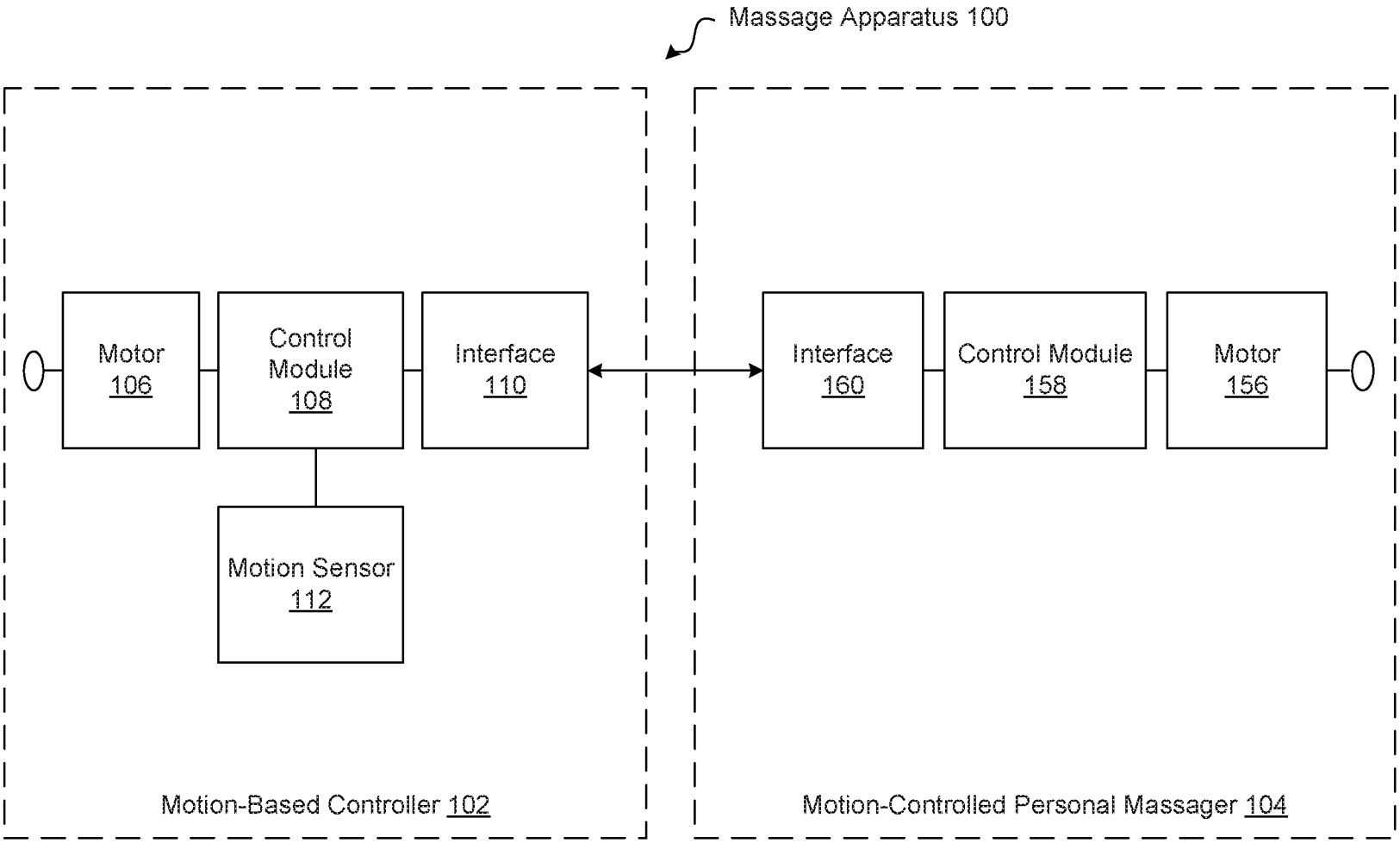
FIG. 1A is a diagram illustrating components of a motion-based personal massage apparatus including a motion-based controller and a motion-controlled personal massager, in accordance with an embodiment of the invention.

Referring first to FIG. 1A, there is shown a diagram illustrating the components of a motion-based personal massage apparatus 100 including a motion-based controller 102 and a motion-controlled personal massager 104, in accordance with an embodiment of the invention. In the embodiment of FIG. 1A, the motion-based controller 102 includes a motor 106, a control module 108, an interface 110, and a motion sensor 112. Also in the embodiment of FIG. 1A, the motion-controlled personal massager 104 includes a motor 156, a control module 158, and an interface 160.

The motion sensor 112 of the motion-based controller 102 is designed to detect motion of the controller 102. A variety of different motion sensors 112 can be used. In one embodiment, the motion sensor is an accelerometer that senses the acceleration of the controller 102. For example, the motion sensor 112 can be a three-axis accelerometer that determines an orientation of the controller in three dimensions, including an X, Y, and Z axis. The sensor 112 can be a capacitive MEMS sensor, a low g inter-integrated circuit (I2C) digital acceleration sensor (e.g., acceleration sensor MMA7660FC by FREESCALE™ SEMICONDUCTOR), or another type of sensor for detecting motion of a device. In one embodiment, the motion sensor 112 is an accelerometer that detects at least six different orientation positions of the controller 102 that correspond to different adjustments in the operation of the massager 104. For example, the sensor can detect orientation positions that include left, right, up, down, back, and front. Each orientation position can correspond to a different setting or control for the massager 104, though in some cases, more than one position can correspond to the same massager setting. In other embodiments, only a few positions corresponding to different settings are used for simpler operation of the apparatus 100. In further embodiments, the sensor 112 is designed to detect shaking or tapping of the controller 102 or other types of controller motion, and these movements can be used to control different settings on the massager 104. For example, a user could tap the controller 102 to change the settings or could tap the controller 102 a certain number of times or in certain locations for different settings. Similarly, the user could shake the controller 102 in different directions to change between settings.

In the embodiment of FIG. 1A, the controller 102 and the massager 104 both include motors 106, 156 for operation of the devices. The motor 106 in the controller 102 can be used to operate different aspects of the controller 102. The massager 104 includes at least one surface that contacts the body (e.g., a human body) or a portion of the body to provide the massage. The motor 156 in the massager 104 generates the motion of the massager 104. The motor 156 can vibrate or otherwise move the massager 104 in a variety of manners. In some embodiments, various vibration patterns or tempos can be created by the motor 156. The motor 156 can move the massager 104 more slowly or more rapidly depending on the setting. In some embodiments, the massager 104 can include more than one motor for operating different portions of the massager 104. In further embodiments, rather than having a motor (or in addition to the motor), the controller and/or massager have vibrator, electromechanical device, or other mechanism for moving the controller/massager.

In some embodiments, the controller 102 can, itself, be a personal massager and provide massage to the body. In these embodiments, the controller 102 can include at least one surface that contacts the body (e.g., a human body) or a portion of the body to provide the massage. The motor 106 in the controller 102 generates the massage motion of the controller 102. The motor 106 can vibrate or otherwise move the controller 102 in a variety of manners, including creating various vibration patterns or tempos. The motor 106 can move the controller 102 more slowly or more rapidly depending on the setting. In some embodiments, the controller 102 can include more than one motor for operating different portions of the controller 102. In further embodiments, both the controller 102 and the massager 104 can be used as personal massagers simultaneously, or the user can rotate between using the controller 102 or massager 104 as a personal massager. Since the controller 102 has a motion sensor 112, the motion sensor can detect motion of the controller 102 and adjust the massage settings of the controller 102 based on this motion.

The controller 102 and massager 104 also include interfaces 110 and 160 that permit the controller 102 and the massager 104 to interact or communicate. Using interface 110, the controller 102 can send control signals or instructions to the massager 104 regarding what setting to implement in the massager 104. For example, the control signals can indicate that the massager 104 should turn on or off, increase or decrease speed, switch to a different vibration pattern, switch to a particular pattern desired by the user, turn on one motor and off another motor, switch between operation of two different motors or different areas of the massager 104, among other instructions. In other embodiments, the massager 104 determines what settings correspond with the motion detected, and the control signals sent by the controller 102 simply provide data regarding the motion detected. In these embodiments, the massager 104 implements an algorithm or otherwise determines how the massager operation should be adjusted.

The interfaces 110 and 160 can be wired or wireless interfaces, such as wireless transceivers that transmit and/or receive control signals between the devices. In some embodiments, the interfaces 110, 160 are radio-frequency (RF) transceivers for transmitting/receiving RF signals between the devices. One example of an RF transceiver that could be used is a low power 2.4 GHz RF transceiver (e.g., transceiver CC2500 by TEXAS INSTRUMENTS®). In these embodiments, the controller 102 and/or massager 104 may also include antennas for transmitting/receiving signals. In other embodiments, the interfaces 110, 160 use other technology for transmitting/receiving signals between the two devices. For example, the interfaces 110, 160 can use BLUETOOTH®, WiFi, infrared, laser light, visible light, acoustic energy, among a variety of other ways to transmit information wirelessly between the controller 102 and the massager 104.

In some embodiments, the controller 102 and/or the massager 104 are connected to a network via a personal computer or a telephone, or are directly connected to a wireless router or a cellular phone network. FIG. 1C illustrates one example of such a design. Thus, the massage apparatus 100 can be controlled via personal computer, phone, etc. by the user with whom the apparatus 100 is in contact or by another user using the personal computer, phone, etc.

In the embodiment of FIG. 1A, both the controller 102 and the massager 104 include a control module 108, 158 that controls the operation of the devices. The control module 108 of the controller 102 can control or communicate with the other components of the controller 102, including controlling the function of the motor 106, controlling or communicating with the motion sensor 112 (e.g., receiving information about motion sensed by the motion sensor 112), and controlling the interface 110. Similarly, the control module 108 of the massager 104 can control or communicate with the other components of the massager 104, including controlling the function of the motor 156 and controlling the interface 160. In some embodiments, the control module 108 of the controller 102 manages the conversion of the motion sensed by the motion sensor 112 into instructions regarding a particular adjustment to the operation of the massager 104. However, this conversion can also be performed by the control module 158 of the massager 104. Similarly, the control module 158 of the massager 104 can implement the instructions and adjust function of the motor 156 to provide the designated adjustment in operation of the massager 104. In embodiments in which the controller 102 can also act as a massager, the control module 108 can further control function of the motor 106 including determining its speed, etc., without being dependent on another controller.

Circuitry in the controller 102 and/or the massager 104 converts the motion of the controller 102 detected by the motion sensor 112 into a control signal for the motor 156 in the massager 104. In this manner, the apparatus 100 can cause an adjustment in the operation of the massager 104 based on the detected motion of the controller 102. In embodiments in which the controller 102 also acts as a massager, circuitry in the controller 102 converts the motion of the controller 102 detected by the motion sensor 112 into a control signal for motor 106 in the controller. Thus, the apparatus 100 can also cause an adjustment in the operation of the controller 102 based on the detected motion of the controller.

The controller 102 can be designed to be a handheld device that the user using the massage apparatus 100, or another user, can hold and manipulate to control the motion of the massager 104. In one embodiment, the operation of the massager 104 is adjustable by a user manually tilting the controller 102 in different directions to change an orientation of the controller 102. This tilting of the controller 102 can, for example, increase or decrease motor power of the massager, change at least one setting of the massager, etc. For example, tilting in one direction could turn the massager 104 on and tilting the opposite way could turn it off. Similarly, tilting the device to the front or back could result in different vibration settings being activated in the massager 104. In addition, tilting at different angles in various directions could modify various settings. Furthermore, shaking the controller 102 in a particular manner or tapping it in particular locations could result in further changes to the settings of the massager 104. These various changes in settings can occur automatically, without requiring user interaction with or manipulation of the massager 104. Thus, the user can adjust the settings of the massager 104 to his preferences while using the massager 104 by simply moving around the controller in different ways. Rather than manipulating buttons on an interface associated with the massager, the user can choose to ignore this interface and instead move the remote controller 102 to control and change settings of the massager 104, as desired.

Figure 1B:
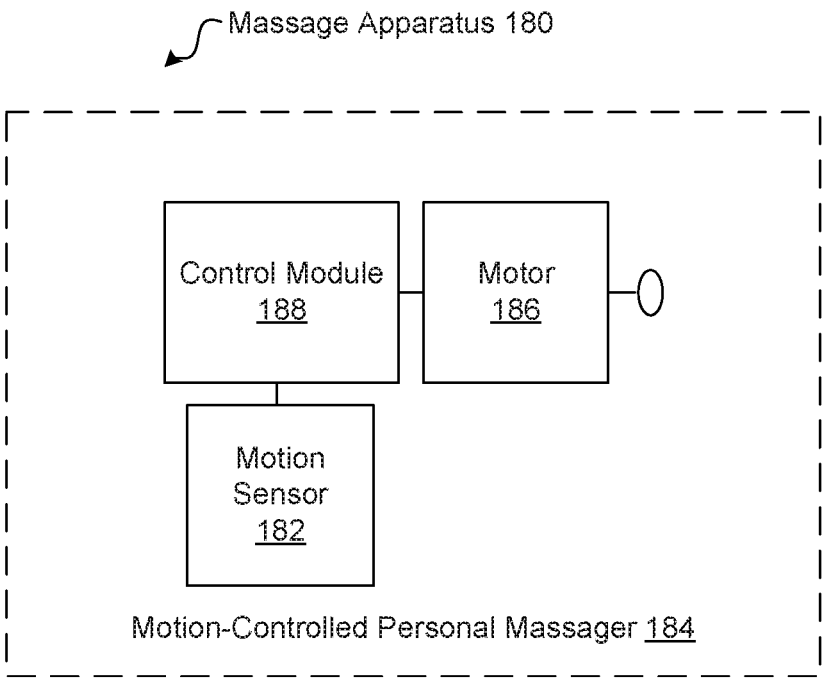
FIG. 1B is a diagram illustrating components of a motion-based personal massager, in accordance with an embodiment of the invention.
Figure 1C:
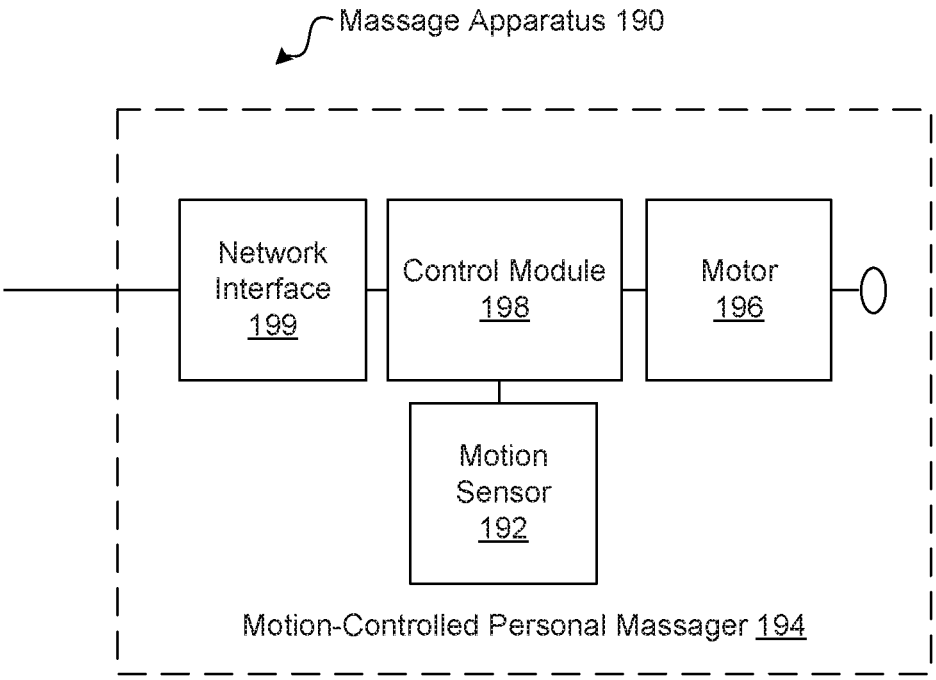
FIG. 1C is a diagram illustrating components of a networked motion-based personal massager, in accordance with an embodiment of the invention.

FIG. 1B is a diagram illustrating components of a motion-based personal massager 184 of a massage apparatus 180, in accordance with an embodiment of the invention. In the embodiment of FIG. 1B, the motion-controlled personal massager 184 includes a motor 186, a control module 188, and a motion sensor 182. In this embodiment, the massager 184 can operate without a controller, such as controller 102, since the massager 184 includes its own motion sensor 182 that is designed to detect motion of the massager 184. Any of the motion sensors described above regarding FIG. 1A can be used as motion sensor 182, and can detect motion in the same general manner. The massager 184 can have the same general design as massager 104. In massager 184, the motor 186 can operate similarly to motor 156, as described above. Similarly, control module 188 can operate similarly to control module 158 as described above. However, in the FIG. 1B embodiment, circuitry in the massager 184 converts the motion of the massager 184 (detected by motion sensor 182) into a control signal for the motor 186 in the massager 184. In this manner, the operation of the massager 184 can be adjusted based on the detected motion of the massager 184, itself, rather than detected motion of a controller. The control module 188 manages the conversion of the motion sensed by the motion sensor 182 into instructions regarding a particular adjustment to the operation of the massager 184. In some embodiments, massager 184 does include a controller, such as controller 102, which can be optionally used with the apparatus 180.

In some embodiments, the user holds the massager 184 in his or her hand and moves the massager around to control operation of the massager. In other embodiments, the massager 184 can be moved around by the user's body. For example, if the massager 184 is resting on or pinned between parts of the user's body (or between parts of two users' bodies), the user (or users) can move his body (their bodies) in order to adjust the orientation of the massager, thereby changing the settings of the massager, as desired. Similarly, a user other than the user who is receiving the massage can move the massager in order to control operation of the massager.

FIG. 1C is a diagram illustrating components of a networked motion-based personal massager 194 of a massage apparatus 190, in accordance with an embodiment of the invention. In the embodiment of FIG. 1C, the motion-controlled personal massager 194 includes a motor 196, a control module 198, a motion sensor 192, and a network interface 199. As explained above, the massager 194 can be connected to a network via a personal computer or a telephone, or can be directly connected to a wireless router or a cellular phone network. Thus, the massage apparatus 190 can be controlled via personal computer, phone, etc., by the user with whom the apparatus 100 is in contact or by another user using the personal computer, phone, etc. The massager 194 can include a controller, such as controller 102, or can be operated without a controller. The interface 199 can be wired or wireless, including any of the interfaces described above regarding FIG. 1A. The massager 194 can operate in generally the same manner as massagers 104 and 184. In this case, since the massager 194 includes its own motion sensor 192, it can operate as described regarding massager 184, including detecting its own motion and translating this into control signals that control the settings of the massager 194.

Figure 2B:
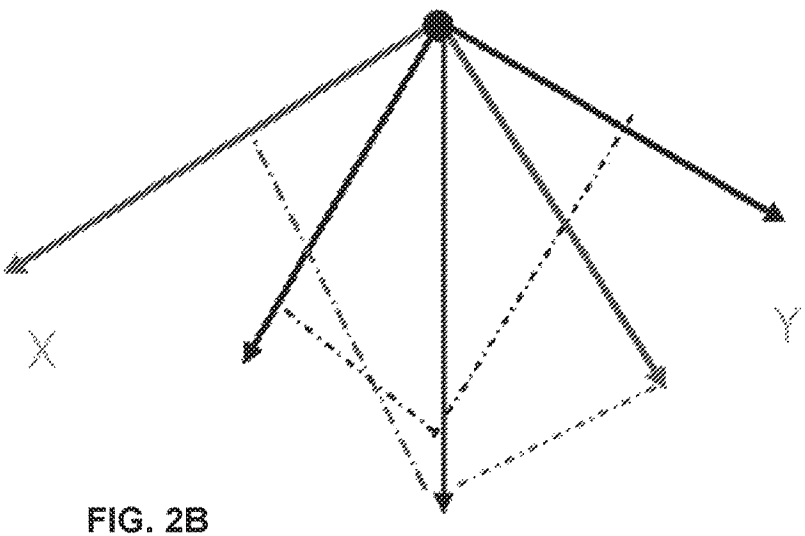
FIGS. 2A, 2B, and 2C are diagrams illustrating a tilt orientation algorithm for use with a motion-based controller and/or motion-controlled personal massager, in accordance with an embodiment of the invention.
Figure 2A:
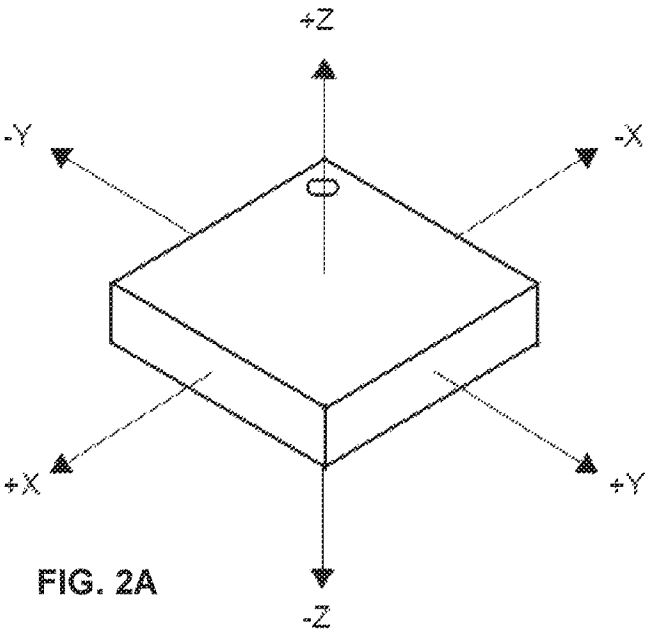
Figure 2C:
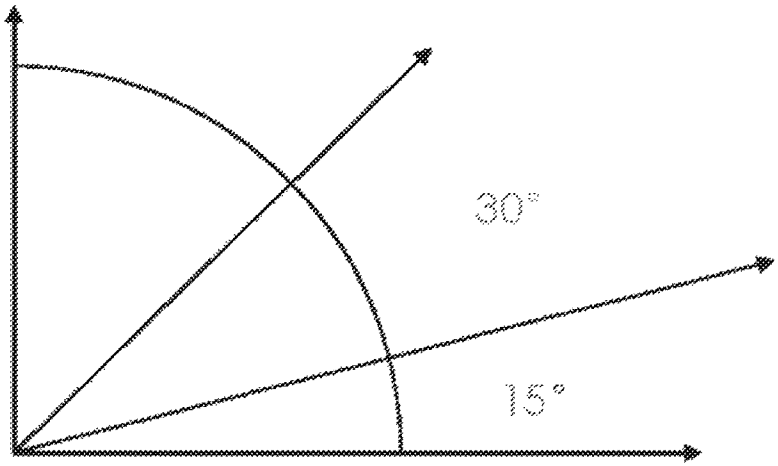

FIGS. 2A, 2B, and 2C are diagrams illustrating a tilt orientation algorithm for use with a motion-based controller and/or massager, in accordance with an embodiment of the invention. FIG. 2A illustrates controller/massager orientations and directions for each axis (X, Y, and Z axes) in composite. FIGS. 2B and 2C provide an example of how the orientation of the controller/massager can be determined along at least two axes. For example, one or both of the control modules 108, 158 can read the X value and Y value from the motion sensor 112 of the controller 102. Similarly, the control modules 188, 198 of the massagers 184, 194, respectively, can read the X value and Y value from motion sensors 182, 192. One or both of the modules 108, 158 or the modules 188, 198 can apply the tilt orientation algorithm to determine a value for the orientation of the controller/massager. As one example, one or both of the modules 108, 158 or modules 188, 198 can calculate a value for $(X^2+Y^2)$, since, for a right triangle, $Z^2=X^2+Y^2$. A filter, such as a digital filter, can be used to remove or wipe out noise from the vibration of the motor 106 of the controller 102 or the motors of the massagers. One or both of the modules 108, 158 or modules 188, 198 can further correlate the value calculated with an adjustment to be made in the operation of the massager 104. FIG. 2C shows an example in which angles of 15 degrees or 30 degrees have been determined. These angles can be correlated with a list of values for output motor power of the massager 104 associated with each value. For example, the list provide below could be used:

15°: Output motor power=5
30°: Output motor power=7
45°: Output motor power=9
60°: Output motor power=11
75°: Output motor power=13
90°: Output motor power=15

Where an angle of 15 degrees has been determined, this correlates with an output motor power of 5 in the above example. Thus, the controller 102 can provide a control signal to the massager 104 indicating that the motor 156 should implement an output motor power of 5 (or this comparison can be performed on the massager 104). Where no controller 102 is included, the massager itself provides the control signal for its own motor. Where a 30-degree angle is detected, an output motor power of 7 is implemented. Similarly, the different angles can correlate with other information or settings, such as turning the massager 104 on or off, particular vibration settings or patterns, different vibration speeds, different parts of the massager 104 vibrating, etc.

FIG. 2 illustrates just one example of an algorithm that can be used with the motion-based controller/massager. Other algorithms can also be used or can be used in combination with the FIG. 2 algorithm, including algorithms that are not orientation-based, but instead are directed to other types of motion of the controller/massager. The above example illustrates some angles and values for the resultant adjustment to the massager operation, but other angles and values can be used, as well. Similarly, different angles can correlate with more than one change or setting for the massager 104.

Figure 3A:
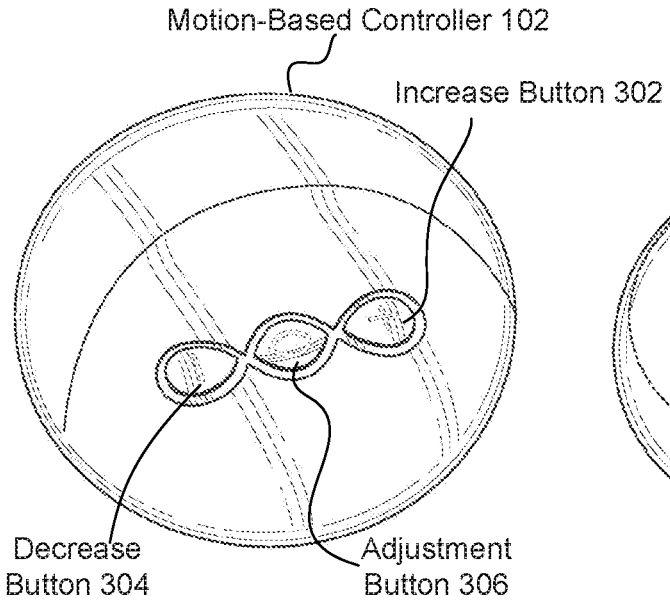
FIG. 3A is a front view of a motion-based controller and FIG. 3B is a perspective view of the motion-based controller, in accordance with embodiments of the invention.
Figure 3B:
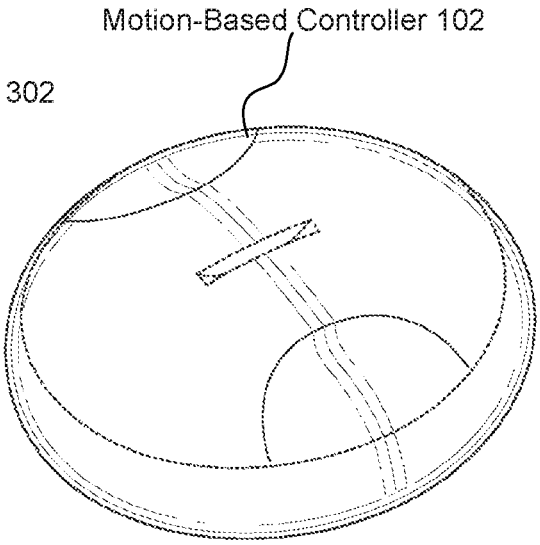

FIG. 3A is a front view of a motion-based controller and FIG. 3B is a perspective view of the motion-based controller, in accordance with embodiments of the invention. In these embodiments, the motion based controller 102 includes an increase button 302 and a decrease button 304 for increasing or decreasing settings of the massager 104 remotely, and an adjustment button 306 for adjusting settings of the massager, such as turning it on or off. One or more of these buttons 302, 304, 306 can be included on the controller 102 if desired, to provide the user with the option to use buttons for some forms of control of the massager. The controller 102 is shown as a palm-sized disk that can easily rest in a user's hand. However, other designs, shapes, and sizes can also be used. In addition, at least one surface of the controller 102 can be put into contact with the body to provide massage, where the controller 102 also operates as a massager.

Figure 4A:
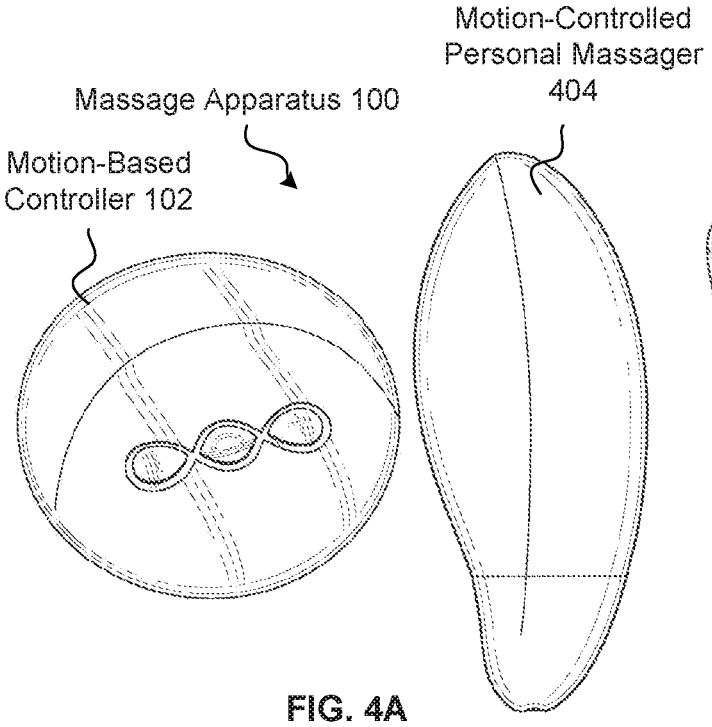
FIG. 4A is a massage apparatus including a perspective view of a motion-based controller and a front view of a motion-controlled personal massager and FIG. 4B is a side view of the motion-controlled personal massager, in accordance with embodiments of the invention.
Figure 4B:
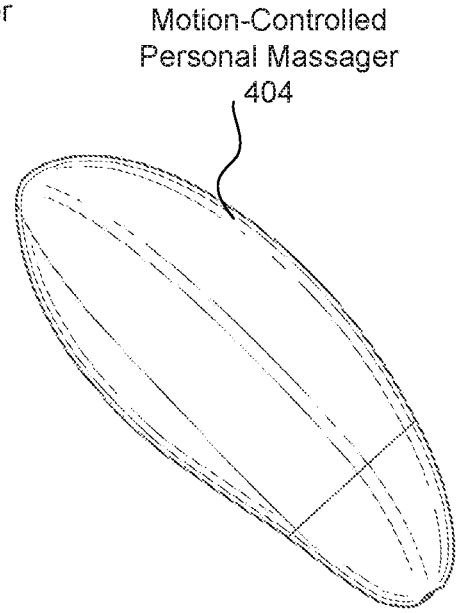

FIG. 4A is an example of a massage apparatus 100 including an perspective view of a motion-based controller 102 and a front view of a motion-controlled personal massager 404, in accordance with an embodiment of the invention. FIG. 4B shows a side view of the motion-controlled personal massager 404 of FIG. 4A, in accordance with and embodiment of the invention. The massager can have any of the designs of massagers 104, 184, or 194. These figures provide one example of a shape for the motion-controlled personal massager 404. In this case, the massager 404 has an egg-like shape, and one or more of the surfaces of the massager 404 can be placed into contact with a user's body to provide vibration to that area. For example, the user can hold the front portion of the massager 404 shown in FIG. 4A and shown to the right in FIG. 4B that is curved for easy grasping. The ridge at the left side of FIG. 4B can be placed into contact with the body to provide the vibration or massage.

Figure 5A:
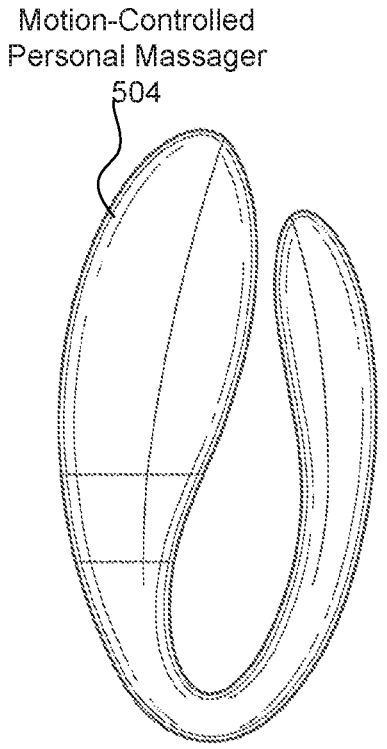
FIG. 5A is a side view of a motion-controlled personal massager and FIG. 5B is a perspective view of the motion-controlled personal massager, in accordance with an embodiments of the invention.
Figure 5B:
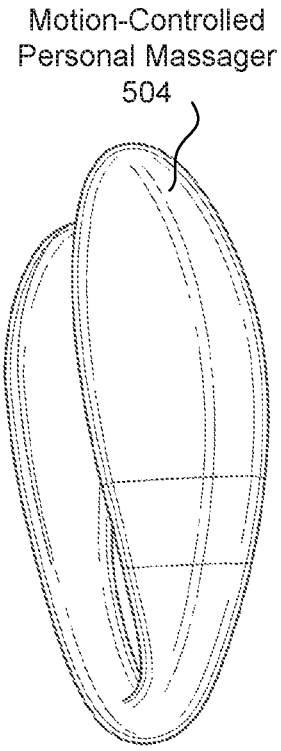
Figure 6A:
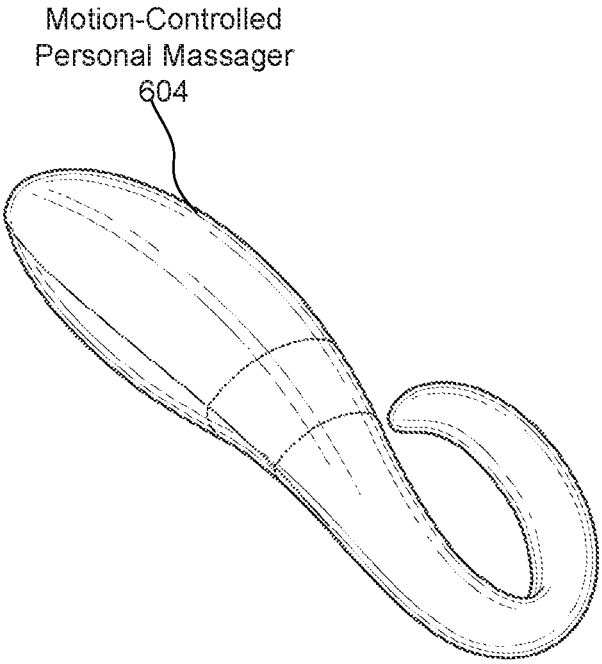
FIG. 6A is a front view of a motion-controlled personal massager and FIG. 6B is a side view of the motion-controlled personal massager, in accordance with embodiment of the invention.
Figure 6B:
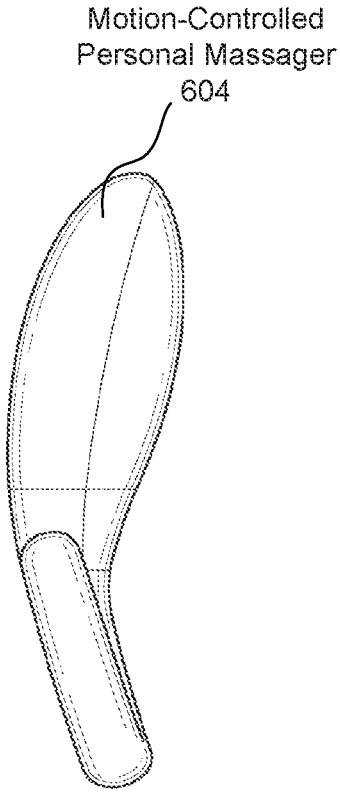

FIGS. 5 and 6 include additional examples of shapes for the massager. The massagers can have any of the designs of massagers 104, 184, or 194. FIG. 5A is a side view of a motion-controlled personal massager 504 and FIG. 5B is a perspective view of the motion-controlled personal massager 504, in accordance with an embodiments of the invention. FIG. 6A is a front view of a motion-controlled personal massager 604 and FIG. 6B is a side view of the motion-controlled personal massager 604, in accordance with embodiment of the invention. Both the FIGS. 5 and 6 designs of the massager 504, 604 are designed to be placed into contact with the body at one or more areas of the body or to be worn on the body, providing massage to one or more areas of the body. For example, the massager of FIGS. 5A and 5B may be worn by a female user with one of the elongate arms placed inside a vagina and another arm placed next to a clitoris, where the connecting portion therebetween allows for vaginal intercourse while the massager is being worn. Similarly, the massager of FIGS. 6A and 6B may be worn with the loop portion around a penis during vaginal intercourse, where the elongate arm is next to a clitoris.

Figure 7:
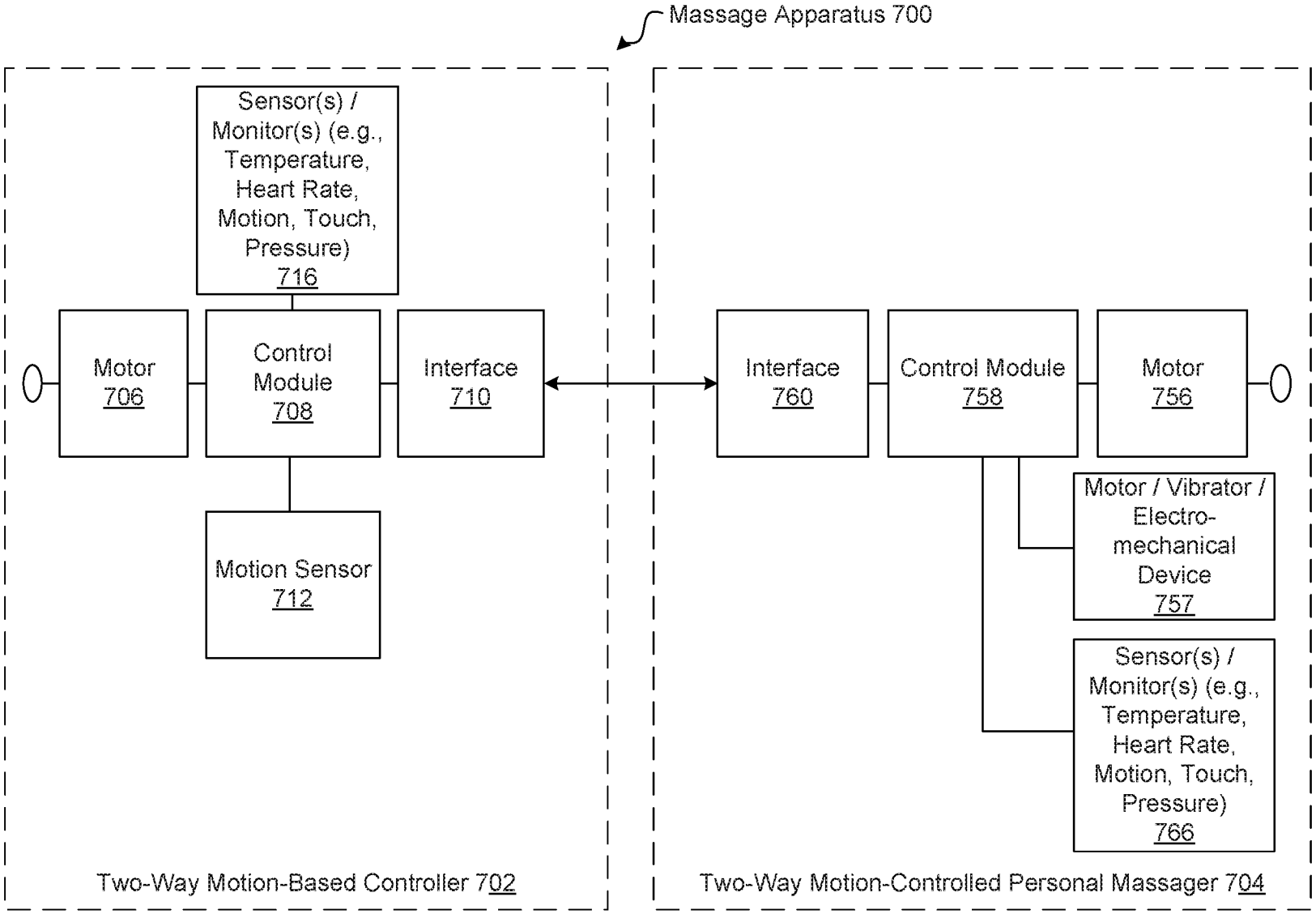
FIG. 7 is a diagram illustrating components of a massage apparatus including a two-way motion-based controller and a two-way motion-controlled personal massager, in accordance with an embodiment of the invention.

FIG. 7 is a diagram illustrating the components of a massage apparatus 700 including a two-way motion-based controller 702 and a two-way motion-controlled personal massager 704, in accordance with an embodiment of the invention. In the embodiment of FIG. 7, the motion-based controller 702 includes a motor 706, a control module 708, an interface 710, and a motion sensor 712. Also in the embodiment of FIG. 7, the motion-controlled personal massager 704 includes a motor 756, a control module 758, and an interface 760. These components of the controller 702 and the massager 704 generally operate in the same manner as the components having corresponding names in the FIG. 1A embodiment of massage apparatus 100. In addition, in the FIG. 7 embodiment, the massager 704 includes a second motor or a vibrator or an electromechanical device 757 (similarly, any of the motors described throughout can alternatively be a vibrator, an electromechanical device, or other device for causing motion). Where this device 757 is a second motor, the second motor 757 can operate in the same or different manner as motor 756. In some embodiments, the second motor 757 can operate different components of the massager 704 or can operate in response to different feedback or motions of the controller 702, and so forth. The tilt orientation algorithm of FIG. 2 can be used with the massage apparatus 700. In addition, the apparatus 700 can employ any of the designs of FIGS. 3-6 or other designs. Furthermore, the massager 704 can be used with controller 102 of FIG. 1A, or the controller 702 can be used with massager 104 of FIG. 1A. In addition, the massagers 184 or 194 of FIGS. 1B and 1C, respectively, can be used instead of massager 704 and/or can be designed to include the additional components of massager 704 that are not shown in massagers 184 or 194 (e.g., device 757, sensor(s)/monitor(s) 766, etc.).

In the FIG. 7 embodiment, the two-way motion-based controller 702 further includes one or more sensors or monitors 716 that detect or monitor one or more parameters associated with the body that is physically contacting the controller 702. In addition, the two-way motion-controlled personal massager 704 also includes one or more sensors or monitors 766 that detect or monitor one or more parameters associated with the body that is physically contacting the massager 704. For example, the sensor(s)/monitor(s) can be temperature sensors, heart rate sensors, motion sensors, touch sensors, pressure sensors, etc. Such sensor(s)/monitor(s) can be included in one of or both of the controller 702 and the massager 704. Similarly, different sensor(s)/monitor(s) can be included in the controller 703 versus the massager 704. For example, either the controller 702 or massager 704 can include a heart rate monitor that monitors the heart rate of the user that is currently contacting the controller 702 or massager 704. The apparatus 100 can be configured such that the controller 702 will automatically respond to the detected heart rate by sending data regarding the specific adjustment in operation that the massager 704 should implement for that heart rate detected. For example, the control module 708 of the controller 704 can send a control signal to the massager based on the detected heart rate, and the control module 758 of the massager 704 can cause one or both of the motors 756, 767 to operate in the manner specified in the control signal. As the heart rate changes, the massager 704 can change operation, including speeding up or slowing down, changing vibration patterns, etc. In a similar manner, as the temperature of the user changes, this can be detected by sensor(s)/monitor(s) 716 or 766, resulting in changes in operation of the massager 704 or controller 702. In addition, as the controller 702 or massager 704 is moved, touched, or put under certain pressure, the massager settings can be adjusted to correspond with this information collected from the user. In some embodiments, one or both of the controller 702 and massager 704 do not include motion sensors, but operate only via sensing of changes in body temperature, heart rate, and other bodily changes.

In some embodiments of the two-way massager apparatus 700 of FIG. 7, the controller 702 and massager 704 can be used to provide massage between two users. In this case, both devices 702, 704 can operate as massagers since both include at least one motor. In some embodiments, both devices 702, 704 include a motion sensor via which motion of the devices 702, 704 can be detected. For example, the massager 704 can include a motion sensor (see, e.g., the design of FIG. 1B) that can be used to detect motion of the massager 704 to control operation of the massager 704. Similarly, the controller 702 can include a motion sensor 712, as shown, to detect motion of the controller 702 to control operation of the controller 702. Furthermore, in other embodiments, both devices 702, 704 can act as controllers for controlling the other device. For example, the massager 704 can include the components of the controller 702 that allow it to act as a remote controller. In this manner, the massager 704 can act as a remote controller for the controller 702. Thus, a user using the massager 704 to receive a massage can control his massager's settings and/or can control settings of the massage being given to another user by vibration of the controller 702. Similarly, a user using the controller 702 to receive a massage can control his massager's settings and/or can control the settings of the massage being given to another user by vibration of the massager 704. Different settings can be used to determine which device controls which other device.

Methods of Motion-Based Control

Figure 8A:
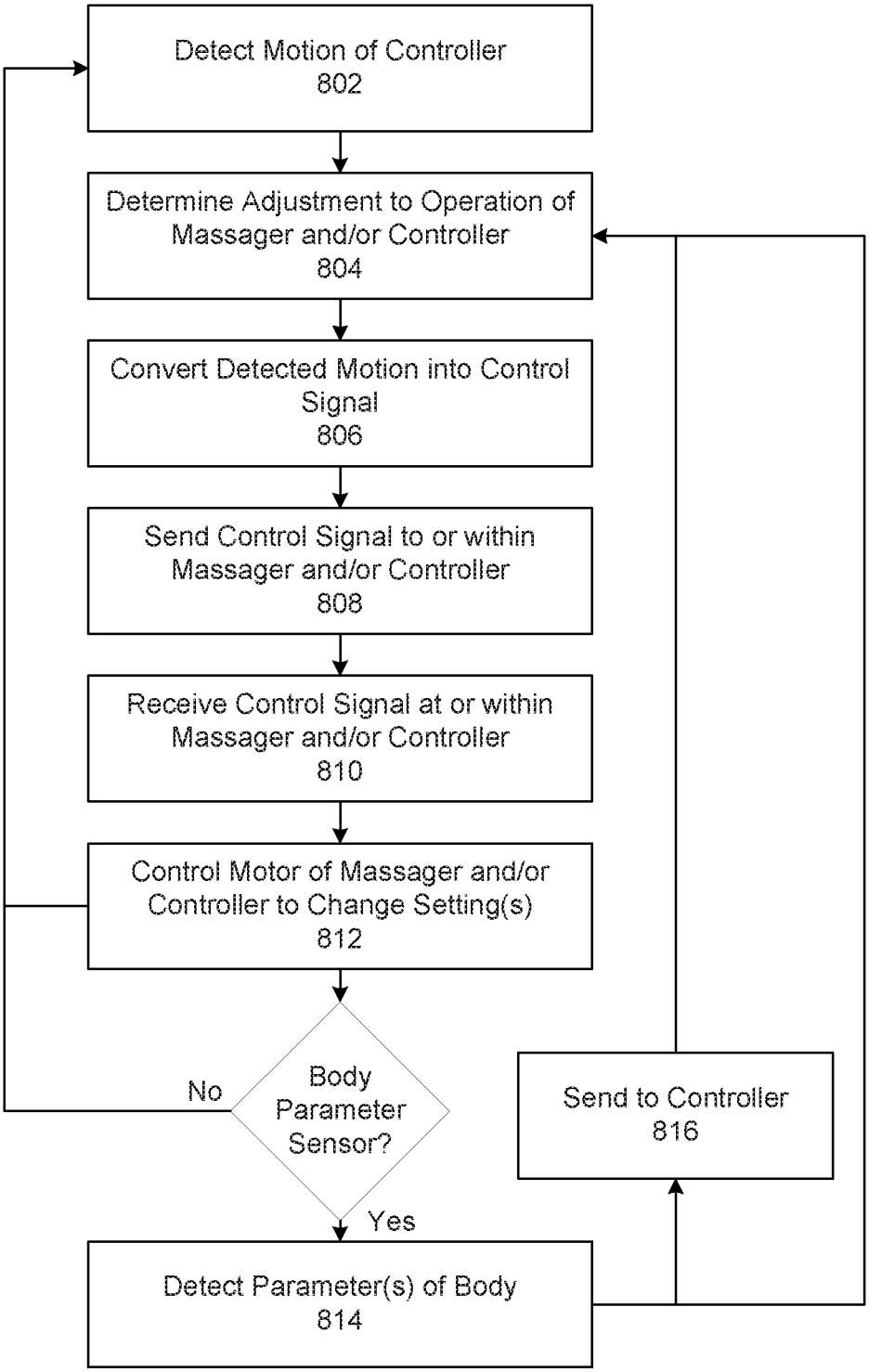
FIG. 8A is a flow chart illustrating the steps performed for motion-based control of a personal massager, in accordance with an embodiment of the invention.
Figure 8B:
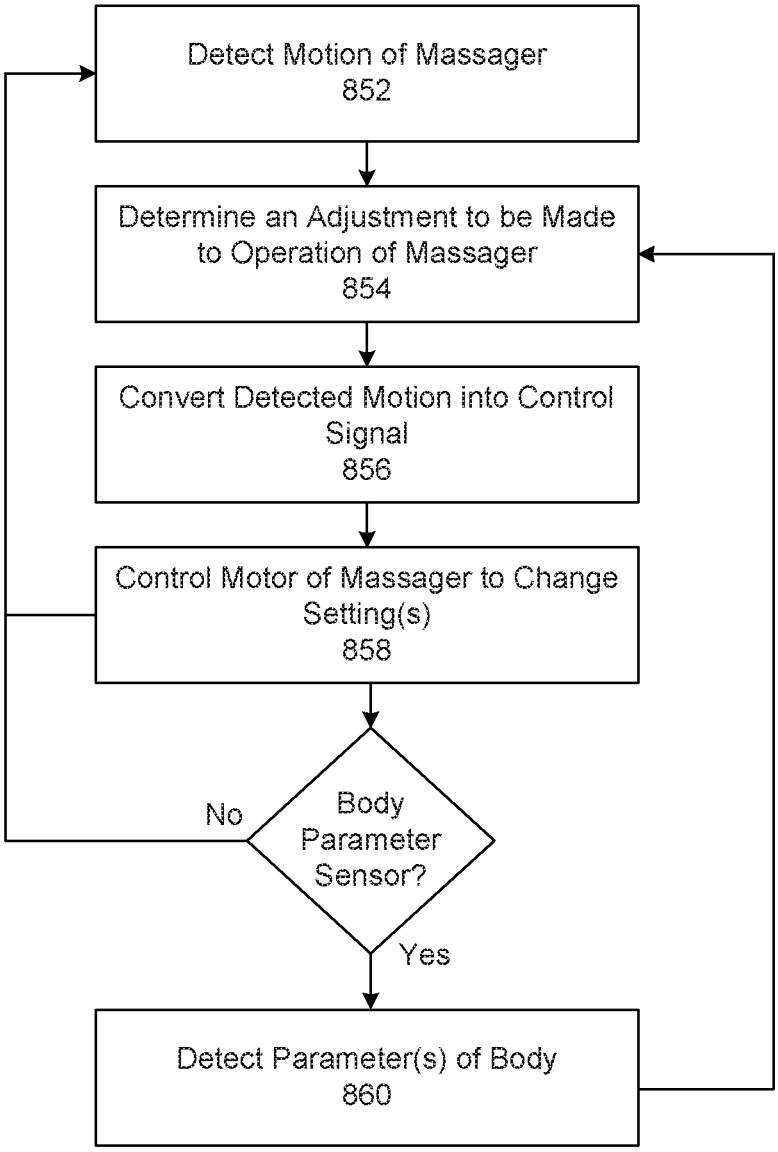
FIG. 8B is a flow chart illustrating the steps performed for motion-based control of a personal massager without a remote controller, in accordance with an embodiment of the invention.
Figure 9:
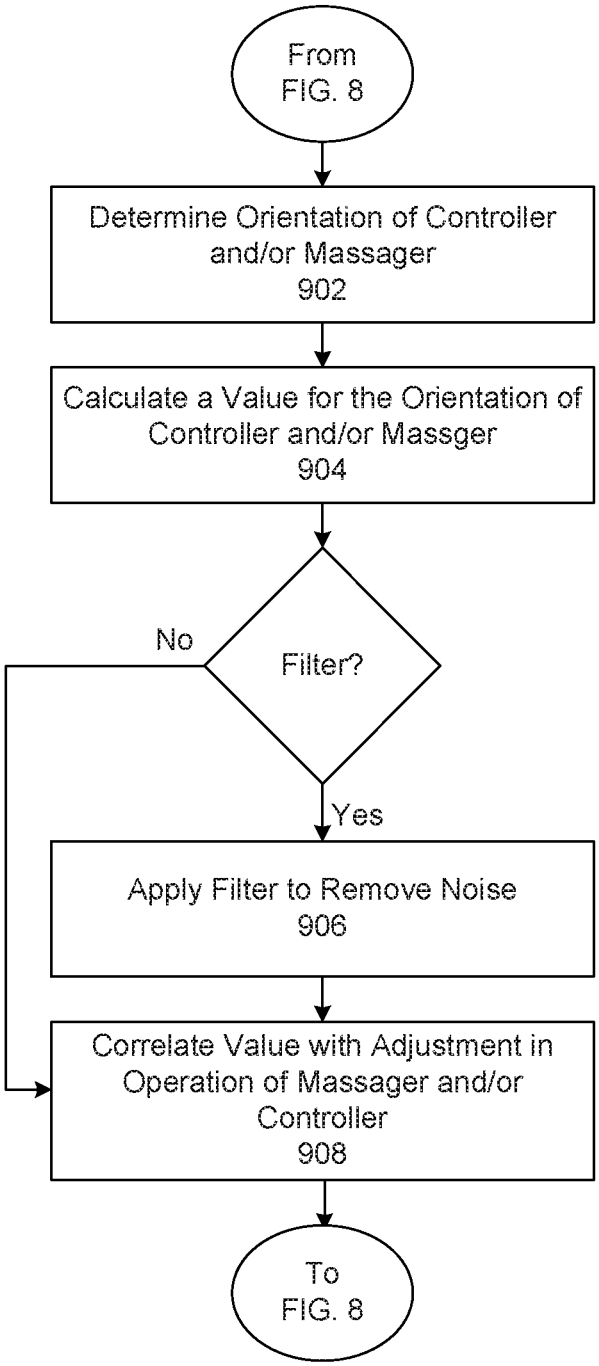
FIG. 9 is a flow chart illustrating the steps performed for determining an adjustment to the operation of a personal massager based on controller or massager orientation, in accordance with an embodiment of the invention.

Referring now to FIG. 8A, there is shown a flow chart illustrating the steps performed for motion-based control of a personal massager, in accordance with an embodiment of the invention. It should be understood that these steps are illustrative only. Different embodiments may perform the illustrated steps in different orders, omit certain steps, and/or perform additional steps not shown in FIG. 8A (the same is true for FIGS. 8B and 9). The method can start and end at various points in the process, and typically is a continuous process with multiple steps occurring simultaneously, so FIGS. 8A, 8B, and 9 provide only an example of one ordering of method steps. In addition, the methods can be performed using massage apparatus 100, 180, 190, or 700 (or one or more of its components, or components of these apparatuses), or any of the designs of FIGS. 3-6, or another apparatus capable of performing the steps provided below.

Various steps of motion-based control of a personal massager are illustrated in FIG. 8A. FIG. 8A describes a method of motion-based control of a personal massager using a controller. One step includes detecting 802 motion of a controller that is in communication with the massager. An additional step includes determining 804 an adjustment to be made to operation of the massager and/or the controller based on the motion of the controller that was detected. As explained above, in some embodiments, both the massager and the controller can provide massage. Thus, the motion detected 802 for the controller can be used to adjust the massager operation, the controller operation, or both.

A further step includes converting 806 the detected motion of the controller into a control signal for the massager and/or controller that adjusts the operation of the massager and/or controller in response to the detected motion of the controller. In certain embodiments, the movement of the controller is converted into control signals to adjust the operation of the controller and massager simultaneously. In some embodiments, the method also includes sending 808 (e.g., wirelessly) a control signal to or within the massager and/or controller and receiving 810 the control signal at or within the massager and/or controller, wherein the control signal is a signal regarding the motion of the controller and/or the particular adjustment to be made to the massager/controller operation. The method can also include controlling 812 the motor of the massager/controller to change one or more settings for the massager/controller, such as an output motor power, a vibration pattern, etc. in response to the control signal. The method can continue to repeat these steps as additional changes in motion are detected 802 resulting in different adjustments to the operation of the massager/controller.

In embodiments in which the massager and/or controller includes a body parameter sensor, the method also includes detecting 814 at least one parameter associated with the human body in contact with either the controller or the massager and adjusting the operation of the massager and/or controller based on this detection by controlling 812 the motor of the massager. Where the body parameter sensor is present in the controller, the controller and/or the massager can determine 804 an adjustment to be made to the operation of the massager, convert 806 this into a control signal, and send 808 this to or within the massager/controller. This information can be transmitted separately or along with the control signals sent regarding motion detected by a motion sensor of the controller. Where the body parameter sensor is present in the massager, this information can either be sent 816 to the controller which can then determine 804 the adjustment, convert 806 to a control signal, and send 808 this back to the massager, or this information can be used directly by the massager in which a control module of the massager implements the required changes and controls 812 the motor of the massager to change the settings. Similarly, this information can be used to make changes to the operation of the controller.

FIG. 8B is a flow chart illustrating the steps performed for motion-based control of a personal massager without a remote controller, in accordance with an embodiment of the invention. One step includes detecting 852 motion of the massager. An additional step includes determining 854 an adjustment to be made to operation of the massager based on the motion of the massager that was detected. A further step includes converting 856 the detected motion of the massager into a control signal for the massager that adjusts the operation of the massager and/or controller in response to the detected motion of the controller. The method can also include controlling 858 the motor of the massager to change one or more settings for the massager, such as an output motor power, a vibration pattern, etc. in response to the control signal. The method can continue to repeat these steps as additional changes in motion are detected 852 resulting in different adjustments to the operation of the massager. In embodiments in which the massager includes a body parameter sensor, the method also includes detecting 860 at least one parameter associated with the human body in contact with the massager and adjusting the operation of the massager based on this detection by controlling 858 the motor of the massager.

Referring next to FIG. 9, there is shown a flow chart illustrating the steps performed for determining an adjustment to the operation of a personal massager based on controller orientation, in accordance with an embodiment of the invention. FIG. 9 further illustrates step 804 of FIG. 8A or step 854 of FIG. 8B, wherein that adjustment is based on detected orientation of the controller and/or massager. The method includes determining 902 an orientation of the controller and/or massager along at least two axes with a motion sensor (e.g., accelerometer) of the controller. The method also includes calculating 904 a value for the orientation detected. Where the controller/massager includes a filter, the method can further include applying 906 the filter (e.g., digital filter) to remove noise due to vibration of the controller motor. The method also includes correlating 908 the value calculated with an adjustment to at least one setting of the massager and/or controller (e.g., turning the massager/controller on or off, changing an output motor power for the massager/controller, changing a vibration pattern for the massager/controller, etc.). In some embodiments, this includes applying a tilt orientation algorithm, such as that described above regarding FIG. 2, to determine a value for the orientation of the controller/massager. This value can be provided or accessed by a control module of the controller or massager for conversion 806, 856 into a control signal for controlling 812, 858 the massager/controller, as described regarding FIGS. 8A and 8B.

While various embodiments have been described above, it should be understood that they have been presented by way of example only, and not limitation. For example, any of the components may employ any of the desired functionality set forth hereinabove. The functions can be distributed differently across the components or different functions can be combined into one component. The massager and controller can be designed to have a variety of different shapes and sizes, and the embodiments shown herein are simply examples of some such shapes and sizes. The internal components of the massager and controller can vary, and can include fewer or more components that those shown here. Thus, the breadth and scope of a preferred embodiment should not be limited by any of the above-described exemplary embodiments.

What is claimed is:

1. A motion-based personal massage apparatus comprising:

a massager body comprising a first arm, a second arm, and a connecting portion connecting the first arm to the second arm in a U-shaped configuration, wherein the massager body is configured to be worn on a body to provide massage thereto;

a motor housed in at least one of the first arm and the second arm of the massager body;

a wireless interface in the massager body, the wireless interface configured to receive control signals and to control an operation of the motor based thereon; and a remote controller comprising:

a user interface for receiving user commands, a motion sensor configured to detect an orientation of the remote controller, and circuitry configured to generate control signals for the motor based on one of received user commands and orientation detected by the motion sensor, each orientation of the remote controller corresponding to a different setting of the massager, and configured to communicate the generated control signals wirelessly to the wireless interface in the massager body.

2. The apparatus of claim 1, wherein the user interface comprises one or more buttons on the remote controller.

3. The apparatus of claim 1, wherein the motion sensor is an accelerometer that is configured to detect at least six different orientation positions of the controller that correspond to different adjustments in the operation of the massager.

4. The apparatus of claim 3, wherein the motion sensor comprises a three-axis accelerometer that determines an orientation of the controller in three dimensions.

5. The apparatus of claim 1, wherein the circuitry of the remote controller is configured to generate control signals to increase or decrease motor power of the motor housed in at least one of the first arm and the second arm of the massager body.

6. The apparatus of claim 1, wherein the circuitry of the remote controller is configured to generate control signals to select a vibration pattern for the motor from a plurality of vibration patterns.

7. The apparatus of claim 1, wherein the remote controller comprises a sensor selected from a group consisting of: a temperature sensor, a heart rate sensor, a motion sensor, a touch sensor, a pressure sensor, and any combination thereof.

8. The apparatus of claim 1, wherein the wireless interface is communicatively coupled to a network via a personal computer or a telephone.

9. The apparatus of claim 1, wherein the massager body is shaped to be worn by a user during intercourse.

10. The apparatus of claim 1, wherein the remote controller is a handheld device.

11. The apparatus of claim 1, wherein the remote controller is a handheld device operable by a user who is receiving the massage and also operable by another user other than the user who is receiving the massage.

12. A method of operation of an apparatus comprising the personal massage apparatus of claim 1 comprising:

contacting the body with the first arm of the massager;

contacting the body with the second arm of the massager; and receiving a control signal from the remote controller regarding instructions for the motor of the massager, the received control signal controlling the operation of the motor based on the instructions of the received control signal.

13. The method of claim 12 comprising:

contacting the body with the first arm of the massager;

contacting the body with the second arm of the massager; and receiving instructions from the remote controller regarding a vibration pattern for the motor selected from a plurality of vibration patterns, the received control signal implementing the selected vibration pattern for the motor.

14. The method of claim 12, wherein the remote controller is a handheld device, and wherein the method further comprises the massager receiving instructions from the remote controller based on one or more user commands received at the remote controller from a user who is receiving the massage or another user other than the user who is receiving the massage.

15. A method comprising:

contacting a body with a first arm of a massager;

contacting the body with a second arm of the massager, a connecting portion connecting the first arm to the second arm in a U-shaped configuration, wherein the massager is worn on the body to provide massage thereto;

receiving, at a wireless interface of the massager, a control signal from a remote controller, the remote controller comprising a user interface and a motion sensor configured to detect an orientation of the remote controller, based on a user command provided at the user interface of the remote controller and orientation detected by the motion sensor of the remote controller, each orientation of the remote controller corresponding to a different setting of the massager; and providing massage to the body using a motor housed in at least one of the first arm and the second arm of the massager, wherein operation of the motor is controlled based on the received control signal that is converted into instructions for the motor in the massager.

16. The method of claim 15, wherein the motion sensor is an accelerometer that is configured to detect at least six different orientation positions of the controller that correspond to different adjustments in the operation of the massager.

17. The method of claim 16, wherein the motion sensor comprises a three-axis accelerometer, and wherein the changes in orientation comprise changes in orientation of the remote controller in three dimensions.

18. The method of claim 15, wherein receiving a control signal further comprises receiving a control signal that selects a vibration pattern for the motor from a plurality of vibration patterns.

19. The method of claim 15, wherein receiving a control signal further comprises receiving a control signal that selects a vibration pattern for the motor from a plurality of vibration patterns, and wherein operation of the motor of the massager is controlled based on the selected vibration setting with the motor.

20. The method of claim 15, further comprising:

receiving a user command at the user interface of the remote controller, the user command indicating a vibration pattern for the massager selected from a plurality of vibration patterns;

generating a control signal for the motor of the massager based on the received user command for the selected vibration; and communicating the generated control signal wirelessly to the wireless interface of the massager.

21. The method of claim 15, wherein one of the first and second arms is worn inside the body and the other of the first and second arms is worn outside the body.

22. The method of claim 15, wherein the remote controller is a handheld device, and wherein the method further comprises receiving a user command at the user interface of the remote controller by a user who is receiving massage from the massager and receiving a user command by another user other than the user who is receiving the massage.

* * * * *